United States Patent [19]

Bender et al.

[11] Patent Number: 4,841,593

[45] Date of Patent: Jun. 27, 1989

[54] HOLLOW WARE AND CHIMNEY CLEANING DEVICE

[76] Inventors: Dennis E. Bender, 614 Spruce St., Sauk City, Wis. 53583; Mark Bender, E8566 Bender Dr., North Freedom, Wis. 53951

[21] Appl. No.: 157,404

[22] Filed: Feb. 18, 1988

[51] Int. Cl.[4] ..... F23J 3/02

[52] U.S. Cl. ..... 15/242; 15/249

[58] Field of Search ..... 15/242, 243, 249, 162, 15/163

[56] References Cited

U.S. PATENT DOCUMENTS

| | | | |
|---|---|---|---|
| 178,007 | 5/1876 | Hobbs et al. | 15/162 |
| 1,293,777 | 2/1919 | Hogue . | |
| 1,315,849 | 9/1919 | MacDonald | 15/243 |
| 1,422,001 | 7/1922 | Sharp et al. | 15/249 |
| 1,543,018 | 6/1925 | Le Feuvre | 15/243 |
| 1,629,990 | 5/1927 | Buchholtz | 15/162 |
| 1,875,613 | 9/1932 | Kahlert et al. | 15/163 |
| 4,254,528 | 3/1981 | Souliere | 15/163 |
| 4,319,378 | 3/1982 | Bowman | 15/162 |
| 4,333,200 | 6/1982 | Thurow | 15/243 |
| 4,353,143 | 10/1982 | Beaudoin | 15/162 |
| 4,365,381 | 12/1982 | Neuman | 15/243 |
| 4,470,168 | 9/1984 | Vickery | 15/163 |
| 4,492,000 | 1/1985 | Skogen | 15/242 |
| 4,498,212 | 2/1985 | Davis | 15/242 |

*Primary Examiner*—Chris K. Moore

[57] ABSTRACT

This cleaning device utilizes two methods, simultaneously, to remove deposits from the conduction channel inside a multitude of various shaped tubes or the like, including round, square, and rectangular chimney flues. The first removes soft, brittle deposits and the second removes hard, glazed deposits through the use of chisel-like edges (35) and file-like grooved rasping surfaces (34) that are integrated in one element, the raspers (30). Raspers (30) can be replaced when dull. This device is well suited for removing creosote deposits from chimney flues; it can go past unyielding obstructions commonly found in chimney flues, and it cleans all surfaces in a section of flue simultaneously. This cleaning device consists of an elongated body (17), smaller but similar in shape to the specific shape tube or flue it is designed to clean, a plurality of semi-elliptical bowed springs (26) projecting a flexible arch outward from and normal to the body side surfaces (23) and spanning said body longitudinally, disposed in spaced-apart relation about said body to form an array with a planform shape similar to the shape of the flue to be cleaned, raspers (30) attached to and clamped around the convex surfaces (33) of the semi-elliptical bowed springs (26), and a long, thin handle (46) reversibly attached and locked onto the center of the top capped end (22) of said body (17) to provide a unitary stroking means whereby this device is reciprocated to and fro inside a flue.

8 Claims, 7 Drawing Sheets

17
28T
27E
30L
59L
37
23
26.26D
34
30
35
25
37
30L
59L
33
27E
56
28B
20
19
35
30
32
36
25
35
34
37
27M
33
29
26.26D 26.26D
27E
28B
56
57
55
20
19
60
17
21.23
60
58

HOLLOW WARE AND CHIMNEY CLEANING DEVICE

FIELD OF INVENTION

This invention relates to mechanical cleaning of conduction channel surfaces inside tubes or the like of elongated lengths, freeing them of foreign deposits to maintain maximum conduction efficiency. Particular consideration of this invention is in chimney flue cleaning involving hard, inflammable creosote deposits.

BACKGROUND OF INVENTION

Each year many chimney fires occur and cause damage because accumulations of poorly burned combustion gases condense on the inside surfaces of chimney flues. These gases condense on flue surfaces cooled below 255 degrees F. forming a hard glaze coating that is extremely resistant to most cleaning techniques. Deposits of this type are not burnt and charred like soot, but instead they are hard, inflammable, and dangerous. This is the type of creosote deposit that ignites during a chimney fire and in doing so swells into a crusty, volumous material as it burns in a very hot and uncontrollable manner.

There is another type of deposit in chimneys that is more brittle and less inflammable so therefore, less dangerous as well. This type of creosote, or soot, is mostly found in areas of the chimney that are hottest, near to the combustion source. Soot and burned creosote can clog chimneys, but layers of it can be removed rather easily by less abrasive means then those necessary to remove glazed creosote layers.

Brush or scraping devices described by prior art can be adequate to effectively remove most soot but they can not remove hard glaze layers very effectively. Periodic cleaning with prior art methods unable to remove the more dangerous, hard creosote deposits can sometimes keep the chimney unclogged, but it does little or nothing to remove the dangerous deposits so they remain as does the potential for ignition and a chimney fire. If this is allowed to continue a steady buildup of glaze forms a thick, hard, and sometimes clumpy, deposit of creosote that can finally reduce conduction channel apertures enough to clog a chimney entirely. It has been our experience to observe this type of clog in chimneys that have been regularly cleaned with prior art brushing or scraping techniques. The only fortunate aspect of this condition is that no chimney fire has yet occured, but this is a very undesirable situation, one not so easy to avoid in some long chimneys that do not heat up much during use. Also undry wood and wood conservation measures such as slow burning in modern airtight stoves increases the likelihood for this to occur. These practices are more common than ever in recent years since wood burning, as a means to heat a home, is increasing in popularity because unstable and generally higher costs for fossil fuels have become reality. The chimney cleaner of this invention is designed to allow the homeowner to have at his disposal an easy and effective means to remove glazed creosote, even if regular chimney cleaning is forgotten from time to time and deposits get fairly thick, to be sure dangerous deposits can not accumulate and clog a chimney or worse yet ignite into a chimney fire.

Prior art described in the patent depository has many references relating to chimney flue cleaning, most of these devices utilize an embodiment or variant of either bristle or scraper elements to provide the cleaning means. Irrespective of how these cleaning devices are designed they possess disadvantages inherent to these basic cleaning elements. Both of these elements exhibit inadequate abrasive properties to remove creosote glaze. If cleaning devices using these elements as the cleaning means are used to clean a chimney only brittle soot and charred creosote deposits are effectively removed, leaving creosote glaze behind and further exposed to increased concentrations of oxygen and higher temperature levels that can even increase the possibility of ignition and the resulting chimney fire. The reason for this problem is clear; thin bristles made from a flexible material bend around obstacles (commonly encountered in chimney flues) very well but they provide only limited abrasive capability because of this flexibility, and scrapers do not have enough applied force (pressing them onto deposits), edge sharpness, or both, to penetrate and cut into the hard, glazed creosote deposits and remove it. Bristle ends scratch as they are forced onto and dragged across deposits, but they have limited ability to dig into and remove deposits because they (that contact deposits) are flexed behind, opposite to the direction of dragging during use. Even the wide, robust bristles of U.S. Pat. No. 4,254,528 by Souliere exhibit these disadvantages. Bristle hardness is also generally a problem with cleaning devices utilizing bristles. Spring steel, the usual material for bristles, is relatively hard but not hard enough to resist wear in part because they are usually thin and slender to remain flexible. Thin material wears away quickly, shortening the ends that abrade over deposits so the bristles become too short and dull to clean with peak effectiveness.

A notable exception to the disadvantages mentioned above is the device described in U.S. Pat. No. 4,470,168 by Vickey that uses axial force generated by wobbling motions created during device free-fall inside a flue to impact chisel-like bristles against deposits to penetrate and chip them. However, limited numbers of bristle members (protruding from this device) and the reliance on random impacts therefrom to chip and dislodge a massive coating of creosote make cleaning slow and unreliable. Furthermore, this gravity dependent design limits it to vertically orientated tubes like chimney flues.

Scraper elements are usually designed excessively large, spreading the outward force applied to them over a long, chisel-like cutting edge. The extent of penetration of a sharp object into a substance is, among other things, directly proportional to the force applied, and indirectly proportional to the size or length of the chisel-like edge. Other facters include scraper sharpness and the angle that the edge(s) contact these substances. The right combination of these properties is required or removal of a hard substance like glazed creosote will be minimal. A scraper that can not penetrate hard substances simply slides over hard creosote deposits as it is stroked across, doing nothing useful. In addition most cleaning devices using scraper elements as the cleaning means do not address wear, and techniques to minimize wear in their design. Dangerous creosote glaze is very hard and tightly stuck to the inner surfaces of some chimneys so very robust scraping elements with specially designed features that circumvent the problems described are necessary to remove it reliably. A means to replace scrapers when worn and construction from hardened, high carbon steel, forged into sharp edges especially constructed to take punishment and wear, are two properties absolutely essential to make an effective scraper.

The cleaning device described in U.S. Pat. No. 1,315,849 by MacDonald consists of scraper elements (cleaning means) made from long chisel-like edges mounted onto a complex mechanical arch made from serial end to end linkage of many steel members loosely joined to pivot. One end of this linkage is connected to a coil spring and the other is held stationary to compress and bend said linkage into an arch whereby scrapers are pressed against opposing flue surfaces. This is a very complex, cumbersome, and expensive linkage by todays standards. A weight and a chain provide the means to stroke this cleaning device to and fro inside a chimney. Even a modest magnitude of force applied to opposing scrapers can pinch this cleaning device inside the flue and halt it progress because the force of gravity on the weight used to provide the downward stroking means has practical limits in this or other gravity dependent designs. In our experience, penetration and removal of creosote glaze requires greater force then this gravity dependent design can offer, especially if the scrapers have long scraping edges as is the case with this device. This device can clean flat and curved surfaces so square and round flues can be cleaned, but only opposite surfaces can be cleaned simultaneously because it only has two opposing scrapers. Thus, the device operator must perform many position changes from a remote position during use to guide it around and completely clean all inner surfaces of the flue. This is a cumbersome task that requires time, patience, and practice to obtain adequate results.

More recent cleaning devices, while still employing bristle or scraper elements as the cleaning means, provide improvements in design to enhance creosote removal. The rather obvious improvements typical to modern cleaning devices are greater bristle stiffness, increased pressing or raking force applied to the cleaning elements, and sharper scrapers. These improvements have limitations and offsetting disadvantages. For example a cleaning device made with bristles of increased stiffness is harder to stroke and less apt to pass unyielding obstructions or offsets commonly found between flue sections so cleaning is incomplete. A scraper type chimney cleaning device must have a means to create force sufficient enough for the scrapers to function and still remain flexible enough to distort and pass obstructions to avoid hooking on them, a very difficult task for prior art designs.

Recent cleaning devices with U.S. Pat. No. 4,319,378 by Bowman et. al. and U.S. Pat. No. 4,353,143 by Beaudoin et. al. use decreased numbers of stiffened bristles and/or decreased overall device size to concentrate the cleaning effort on small discrete areas of inner flue surfaces at any one time. These cleaning devices are as a rule more effective in glaze removal, but not enough and they are slow, inconvenient, and difficult to use for reasons already discussed. The cleaning device by Bowman is complicated to construct; it has swivel and threaded journals to permit expansion of its size by handle rotation, and it requires many such remote adjustments and position changes that can be very difficult if the device is far into the flue. The brush-like cleaning device by Beaudoin, comprised of a few stiff bristles, has low bristle density so many reciprocating strokes are needed to scratch away a coat of creosote and the flexible unitary stroking means thereof easily allows pull strokes (toward the operator) but push strokes (away from the operator) are not easy in long flues that are clogged, especially if obstructions are present therein. Our experience indicates that these bristles will slide over and remove only brittle, loose deposits and leave the hard glaze behind because they are attached to a break mechanism whereby they fold behind the device and allow it to pass obstructions.

U.S. Pat. No. 4,333,200 by Thurow, U.S. Pat. No. 4,498,212 by Davis, and U.S. Pat. No. 4,492,000 by Skogen describe more recent cleaning devices that use scraper elements. These and all cleaning devices that use scrapers have a means to pres them onto deposits, but the usual long blunt edge on nonreplaceble scraper elements of these devices can not easily penetrate into hard glazed creosote. In addition patents by Skogen and Thurow illustrate devices that can only clean opposite surfaces, not all crossection surfaces of a flue simultaneously. The device described in the Davis patent can only scrape one small surface area of a flue at a time and must be moved often to clean other surfaces. Thus, both of these cleaning devices require many position changes, performed by the remote operator, to cover and clean all flue surfaces coated with creosote; both are slow and inconvenient to use, and the device described by Skogen can only clean uncurved surfaces (as illustrated) limiting its usefullness in round flues.

U. S. Pat. No. 1,293,777 by Hogue describes a device to clean round oil pipes. Sludge deposits clogging oil pipes, much different then hard creosote, are removed by an array of four bowed springs under rotation in combination with a liquid stream under pressure. Bowed springs of this invention also do not have separate or integral scraping means in any form attached thereon so they can not grind and scrape away typical hard deposits. Liquid is also undesirable in many cleaning chores so its applications are limited as a result.

Heretofore, with prior art cleaning devices or methods including improved devices of recent years, chimney flue cleaning remains a dirty, slow, and inconvenient job; thus, a need for a better apparatus to enable complete, quick, and easy chimney cleaning, while being durable, simple, and inexpensive to manufacture remains. This invention described in the following text is able to completely clean a chimney (or other hollow ware), removing hard and tightly stuck deposits like inflammable creosote that usually is left behind, unlike any prior art methods or cleaning devices to our knowledge.

OBJECTIVES AND ADVANTAGES

The object of this invention is to provide a means of mechanically removing hard deposits from boundary surfaces of the conduction channel inside tubes. Circular, square, and rectangular shaped tubes or the like can be cleaned with a form of this invention that has a correspondingly shaped planform. Furthermore, this cleaning device is designed to provide effective removal of such deposits very easily and conveniently. This device is also resistive to wear and the resulting decrease in performance since parts suffering wear can be replaced easily and inexpensively. A particular object of this invention is removing creosote glaze from sometimes irregular inner chimney flue surfaces. Removing hard glaze deposits of creosote from a flue is certainly not an easy task, as exhibited by the large number of patents granted to cleaning devices claiming to do just that. The chimney cleaner of this invention can perform the task effectively because it processes design novelties that give it many advantages over prior art cleaning devices.

First and foremost, the raspers (cleaning means) that scrape against creosote are intentionally designed to be small in surface area, very hard, very sharp, and user replaceable. They feature salient edges and a grooved surface much like a file to remove creosote by two methods depending on the deposit consistency encountered. For relatively soft soot deposits and charred, brittle creosote the salient cutting edges are the most effective. They can penetrate and cut into deposits easily to scrape them away. Harder, unburnt creosote glaze left behind, too hard to be penetrated by the salient edges, can be ground away and removed by the hardened grooved surface acting as a rasp-file. This small grooved surface area of each rasper concentrates applied spring generated force on a relatively small area of glaze so they can, with repeated strokes, grind a deep path through such glaze deposits. In addition experimental evidence shows that, while cutting a path, raspers of this type are disruptive enough to the surrounding glaze to cause erosion of glaze near, but not physically located in its (rasper) path during a stroke. Thus, deposits between rasper coverage are also generally removed. Square and rectangular planform cleaners (planform is referring to the plane that contains all raspers and slices through a crossection of the device body) are designed to rely on this effect; they have a planform array of spaced-apart raspers (each attached on members in the bowed spring array) that are able to engage an entire flue crossection and all four inner flue surfaces and corners simultaneously. Referring to FIGS. 5 and 6 it can be seen that these cleaners simply require to and fro strokes inside the chimney since all sides are cleaned simultaneously. The circular planform cleaner can be rotated as it is stroked to remove all deposits (FIG. 4). In addition the hardened steel raspers of this invention minimize wear, and the user replacement feature enable easy replacement of worn and dull raspers to maintain like-new cleaning efficiency without the need for major future expenditures. This cleaning device is very reliable and it provides an easy, fast method for the removal of hard deposits, inexpensively, for many years.

Secondly, the chimney cleaner of this invention utilizes a novel spring system to generate outward force. This force, generated by the springs to press raspers onto deposits, has to be adequate in magnitude to penetrate or grind away hard glaze. Common construction practices as mortar joints and korbling of flue sections, among other things, can leave obstructions or flue offsets that hinder or sometimes even block cleaning attempts. Thus, a spring system must be able to provide adequate force and maintain enough flexibility to contort and pass arround these problem areas. To reach this result a plurality of thin, spring steel strips are attached to a body by two ends thereof in such a fashion that an arch-like curvature is formed projecting radially outward from its base, the device body. This semi-elliptically shaped bowed spring is a member of a set that forms an array that encircles said body with arch-like curvatures. One or more raspers are clamped across the convex surface of each bowed spring member to provide the scraping means comprised of a salient edge and a raised rasping surface to engage creosote deposits. The array is compressed and crushed inward toward the body when it is squeezed by forcible insertion inside tubes. A semi-elliptical bowed spring acts as a flexible arch that can and does flatten or crush under this compression. The energy of compression is stored in the distorted curvature as its potential to regain the original, relaxed shape. Thus, raspers salient to the convex surface of the semi-elliptical spring are pressed outward, distal to the device body, onto the inner walls of the tube. As the device is reciprocated to and fro inside the compressed semi-elliptical bowed springs transfer similar movements to the raspers so they can scrape and grind away creosote. Also the continuous curvature of a semi-elliptical bowed spring, bilateral to the center rasper (at the midpoint) bend contacts obstructions first as the device is stroked and in doing so provides an inclined curvature that guides the rasper around. Furthermore, each bowed spring is independent of the others so those encountering flue surface irregularities or obstructions bend without effecting the performance of others in the array as they simply flex around and slide by. The bowed springs of this invention can provide adequate outward force pressing raspers onto creosote deposits to remove it while maintaining enough resilience to contort around flue obstructions or offsets as are encountered so the cleaning device will not hook and become a stuck inside the flue.

Thirdly, unlike most recent prior art, this chimney cleaner simultaneously cleans all surfaces of a section of the conduction channel inside a flue so numerous complex manipulations such as: device adjustments or position changes (besides simple rotation via the handle as is the case with the round form) are not needed as the device is stroked in the flue. This invention only requires simple to and fro motions to simultaneously clean all inner surfaces of a flue conduction channel. This benefits the casual user by providing adequate cleaning everytime with simple techniques easy to learn and remember.

Fourth, this chimney cleaner can be made with specific planform shapes that can match and effectively clean all modern flue shapes and most tube shapes. Furthermore, another embodiment of this invention features manual adjustment of the bowed extent of each semi-elliptical spring member so the overall planform size of a single chimney cleaner can be changed to clean a wide range of nonstandard flue or tube sizes. Adjustment also can change the amount of curvature compression that each semi-elliptical bowed spring undergoes during use in a particular size flue to change the magnitude of the outward force pressing on the raspers so the cleaning device can be made to insert and reciprocate with the desired amount of friction suited for the cleaning conditions; a chimney cleaner adjusted to minimal size can be used to clean clogged flues initially until larger sizes can be used to finish the cleaning job. This cleaning device can be adjusted to allow an operator of ordinary strength and/or one in an awkward position to easily stroke it.

Fifth, this cleaning device is easy and inexpensive to build. Spring steel strips necessary to construct it can be readily obtained. No complicated linkage or elements are employed and all device elements can be replaced by the user if needed. Since rasper units are separate from the bowed springs in this design they can be made much harder (file hard) then the flexible materials used for the semi-elliptical bowed springs to minimize wearing.

Sixth, this cleaning device can be designed to be self adjusting in accordance with another embodiment of this invention so the bowed extent of the semi-elliptical bowed spring curvature can be automatically regulated during operation to compensate for varying deposit thickness and conduction channel aperture sizes to avoid over compression of the spring members. In summary, the adjustment feature enables this invention to be fine tuned for a specific size of hollow ware and/or the thickness of deposit buildup adhering therein, making it a good candidate for professional use.

The cleaner of this invention offers many further objects and advantages that will become apparent from a consideration of the drawings and the ensuing description of it.

LIST OF REFERENCE NUMERALS

Figure 1:
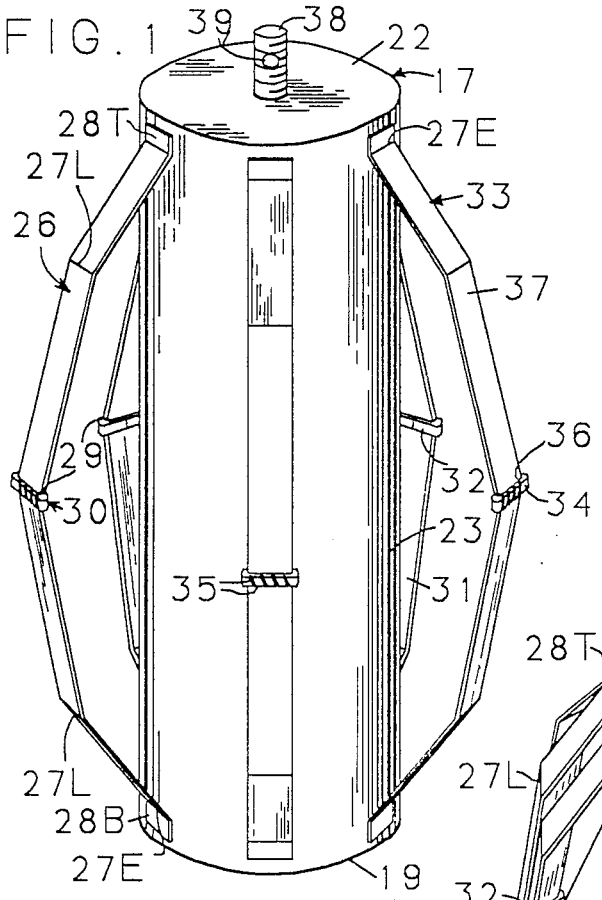
FIG. 1. Perspective view of a chimney cleaner for round flues or tubes.

17: body
18: cavity of 17
19: open end of 17
20: slot in 21 and 23 of 17
21: bevelled side(s) of 17
22: capped end of 17
23: side of 17
24: spring strips
24D: diagonal spring strips
25: notches in 24, 24D, 26, and 26D
26: kinked, semi-elliptical bowed spring (kinked bowed spring)
26D: diagonal kinked, semi-elliptical bowed spring (diagonal, kinked bowed spring)
26U: unkinked, semi-elliptical bowed spring (unkinked bowed spring)
27M: bend at midpoint of 26 and 26D
27L: bends lateral to 27M
27E: bends near end of 26 and 26D
28T: end section of 26 and 26D mounted near 22 of 17
28B: end section of 26 and 26D mounted near 19 of 17
29: peak of 26 and 26D
30: rasper
30L: lateral raspers
31: concave surface of 26 and 26D
32: end tabs of 30
33: convex surface of 26 and 26D
34: grooved rasping surface of 30
35: edges of 30
36: groves in 34
37: incline surface of 26 and 26D
38: threaded stud
39: clasp hole in 38
40: chimney flue
40C: circular chimney flue
40S: square chimney flue
40R: rectangular chimney flue
41: inner surface of 40 (boundary of flue's conduction channel)
42: creosote deposits on 41
46: handle assembly
47: handle section
48: nut of 46
50: clasp hole in 48
52: threaded hole in 48
54: pin clasp
55: hole in 24, 24D, 26, and 26D
56: bolt through 55
57: threaded stud of 56
58: nut for 56
59L: lateral notches in 24, 24D, 26, and 26D
60: lockwasher
62: rivet
64: sliding bracket
66: hook hole in 64
68: rivet hole in 64
70: coil spring
72: bracket hook of 70
74: tab hook of 70
76: tab from 17
78: bend to make 76
79: tab cutout to make 76 from 17
82: notch in 76
83: offset in 40
85: path through 42 cut by 30
86: loop of 29 (meander)
87: chimney

DESCRIPTION OF THE PREFFERED EMBODIMENT(S)

Figure 2:
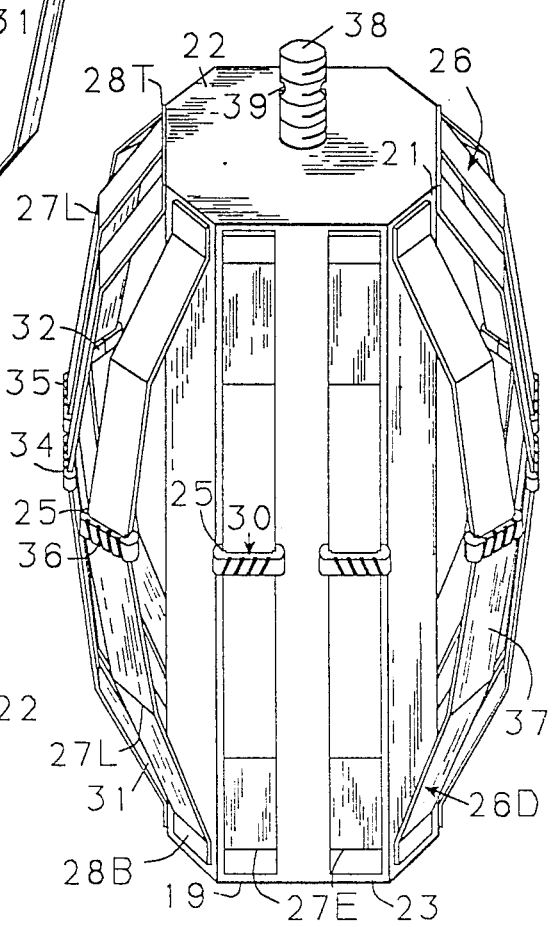
FIG. 2. Perspective view of a chimney cleaner for square flues or tubes.
Figure 3:
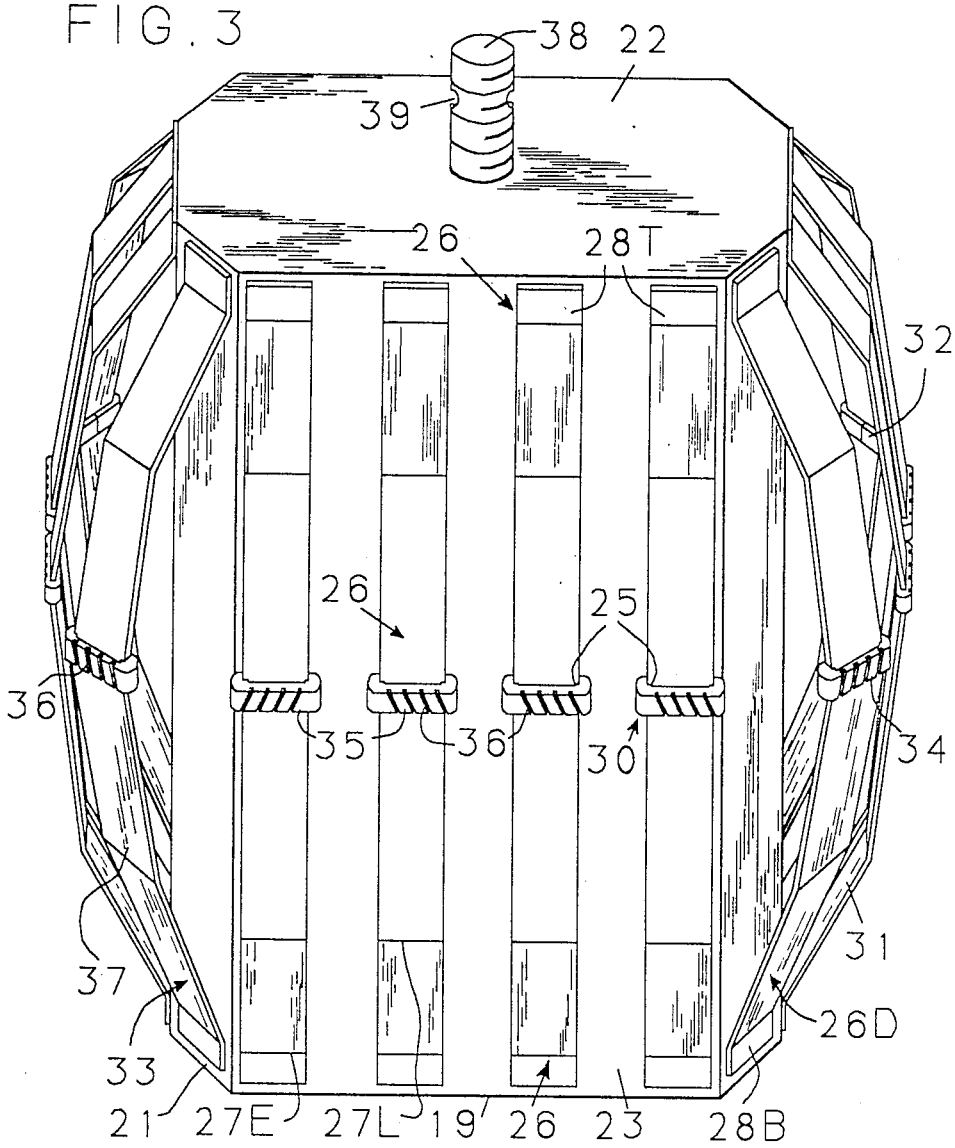
FIG. 3. Perspective view of a chimney cleaner for rectangular flues or tubes.
Figure 5:
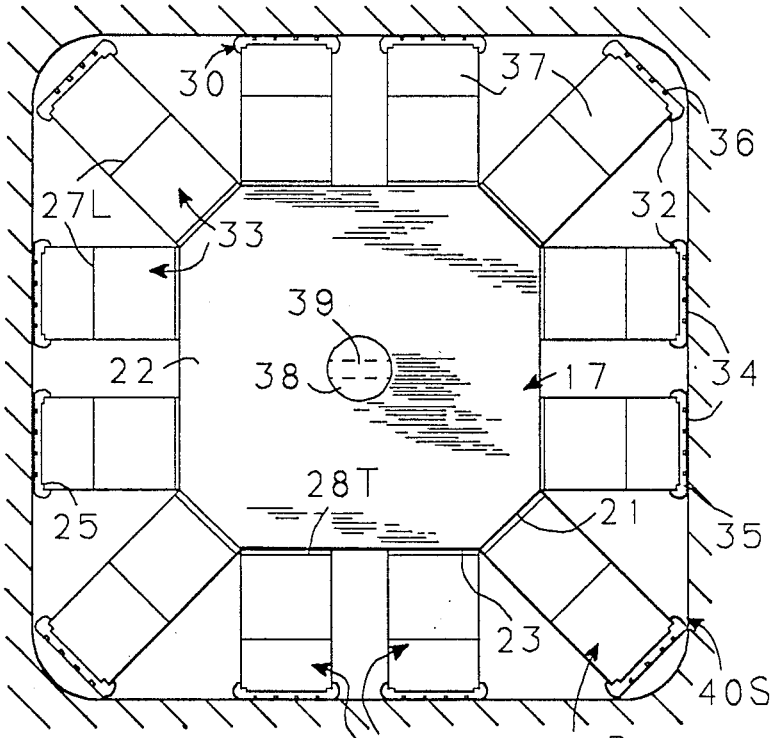
FIG. 5. Crossectional view of a square flue and square form of chimney cleaner with square planform, inserted therein.
Figure 4:
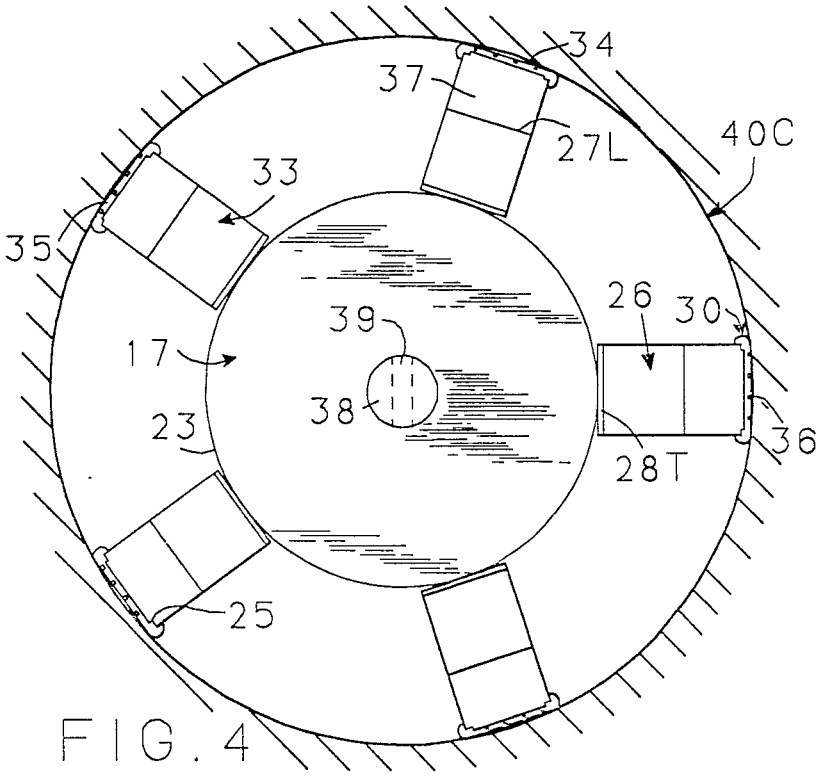
FIG. 4. Crossectional view of a round flue and round form of chimney cleaner with circular planform, inserted therein.
Figure 6:
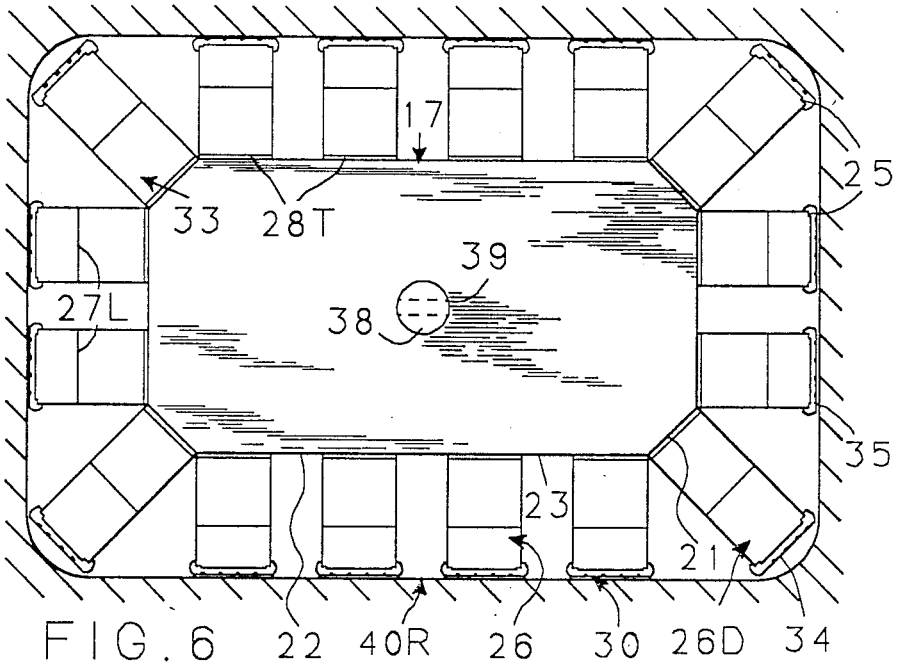
FIG. 6. Crossectional view of a rectangular flue and rectangular form of chimney cleaner with rectangular planform, inserted therein.

Referring now to the drawings and more particularly to FIGS. 1, 2, and 3, showing perspective views of this chimney cleaner invention in three forms, each with a different planform to clean flues or tubes of round, square, and rectangular crossections, respectively. All three forms of the chimney or hollow ware cleaner includes a body 17 consisting of a capped end 22, side(s) 23, and in the square and rectangular forms, chambered side(s) 21 as well. The open end 19 is not covered so body 17 is essentially an open-ended hollow shell surrounding cavity 18 (Shown in FIG. 15) to decrease weight. Each chimney cleaner form has a unique body 17 smaller, but similar in shape to the crossection of the flue it is designed to clean. In the round chimney cleaner body 17 is cylindrical in shape closed at one end, the capped end 22, and open on the other open end 19. The body 17 for the square chimney cleaner has a square shape with bevelled corners as does the rectangular chimney cleaner with a rectangular shape; thus, they both have eight perimeter sides consisting of four bevelled sides 21 and four sides 23. Body 17 crossectional shape is very important because it provides a base to which many spring strips 24 and 24D (shown in FIG. 7, an edge view) can be mounted to form a planform array that radiates outward therefrom to provide optimal coverage of inner surfaces 41, including the corners of square 40S and rectangular 40R flues. FIGS. 4, 5, and 6 show top views of this invention in three forms with differing planforms inserted into flues to illustrate this. All three cleaning device forms can be seen to have a set of thin, flexible spring strips 24 and 24D (shown in FIG. 7), each of which is flexed and mounted to a particular position spaced apart from others on body 17, to form an array of kinked, semi-elliptical bowed springs 26 (and 26D in the square and rectangular forms) which project a plurality of flexible arched curvatures outward from all side surfaces (excluding top capped end 22), about said body 17 toward the inner surfaces 41 of round 40C, square 40S, and rectangular 40R flues, respectively. These are the most common, flue crossections in use today.

Figure 7:
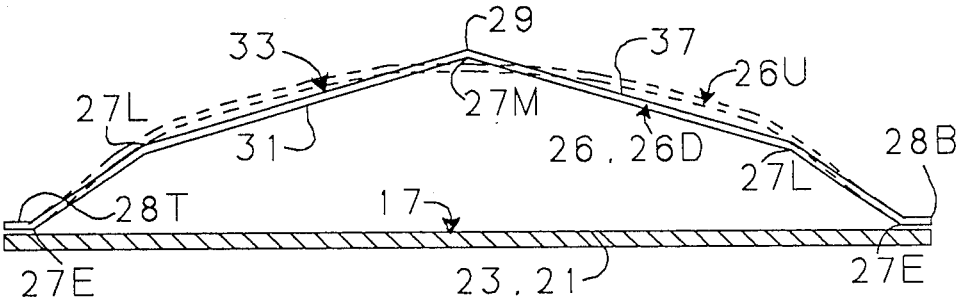
FIG. 7. Side view of a single thin spring strip secured to base to form a kinked, semi-elliptical flexible arch bowed outward from the chimney cleaner body.

In the case of the round form, shown in FIGS. 1 and 4, body 17 is cylindrical in shape consisting of a top capped end 22 surface, side 23 surface, and an bottom open end 19 that is similar in crossection to a round flue. In the preferred embodiment spring strips 24 (shown in FIG. 7) are bent prior to mounting to permanently kink the spring steel in five places with bend 27M (shown in FIG. 7 and 9) at the midpoint, bends 27L lateral to the midpoint, and bends 27E near both ends. FIG. 7 shows how these bends kink the curvature to form a peak 29 at its midpoint and two end sections 28T and 28B thereof, used to connect it to sides 23 of body 17. As shown n FIG. 1 end sections 28T and 28B of spring strip 24 are lapped and attached to the side 23 surface of cylindrical body 17 in two separate positions, one near the top capped end 22 and the other near the bottom open end 19 opening such that the distance between them is less then the physical length of spring strip 24 itself. This produces a natural tension that forces bend 27M to bow or flex outwardly away from side 23 into peak 29 forming a kinked, semi-elliptical bowed spring 26. The resulting flexible arch longitudinally spans the cylindrical body 17 from the top capped end 22 to the bottom open end 19. FIG. 7 shows a side view of the typical curvature of a kinked, semi-elliptical bowed spring 26 in contrast to the curvature of an unkinked, relaxed bowed spring 26U delineated with dotted lines. FIG. 4 shows how a plurality of kinked, semi-elliptical bowed springs 26 lap welded, as described above in spaced apart relationship around the perimeter sides 23 of cylindrical body 17 forms a circular planform chimney cleaner. Furthermore, as shown in FIG. 9 each kinked, semi-elliptical bowed spring 26 (and 26D on square and rectangular cleaners) has two notches 25, one on each side directly across its width at the midpoint on bend 27M on peak 29 to interlock with end tabs 32 of raspers 30.

Experimental evidence indicates that a very steep curvature hinders flexion around obstructions so practical limits to the maximum curvature height exist. A good rule of thumb is that in the relaxed curvature for a kinked, semi-elliptical bowed spring 26 (and 26D), the peak 29 to body side 23 surfaces should be no more then about 25% of its base length, the length between ends 28T and 28B.

Figure 10:
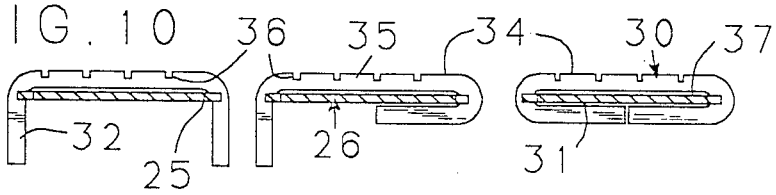
FIG. 10. A series of spring strip crossections illustrating the procedure for rasper attachment to convex surface of kinked, semi-elliptical bowed spring.
Figures 9, 11, 13:
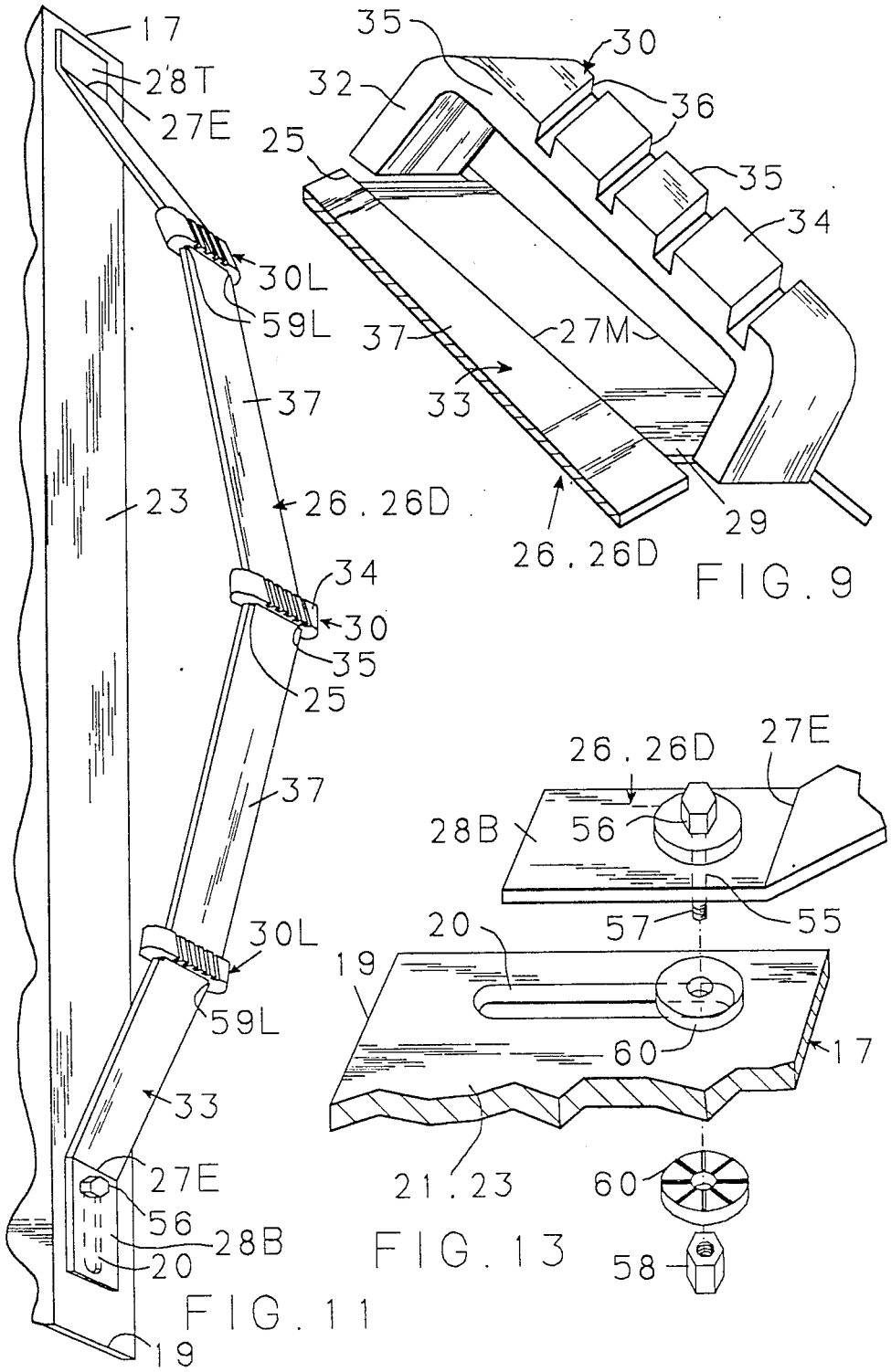
FIG. 9. Enlarged perspective view of a rasper positioned to engage notches of spring strip.
FIG. 11. Perspective view of one kinked, semi-elliptical bowed spring with three raspers attached, one at each kink of spring strip (another embodiment of the invention).
FIG. 13. Enlarged perspective view showing details of the adjustment means assembly.

FIGS. 9 and 10 show in detail how raspers 30 are attached. End tabs 32 of raspers 30 interlock with notches 25 and then are bent about to the concave surface 31 of kinked, semi-elliptical bowed spring 26 (and 26D) to securely clamp and fasten them. Raspers 30, clamped in position, display grooved rasping surface 34 and edges 35 salient from the convex surface 33 of a kinked, semi-elliptical bowed spring 26 (and 26D) to scrape and grind away creosote deposits 42 (shown in FIG. 16) as they are pressed thereupon.

Figure 8:
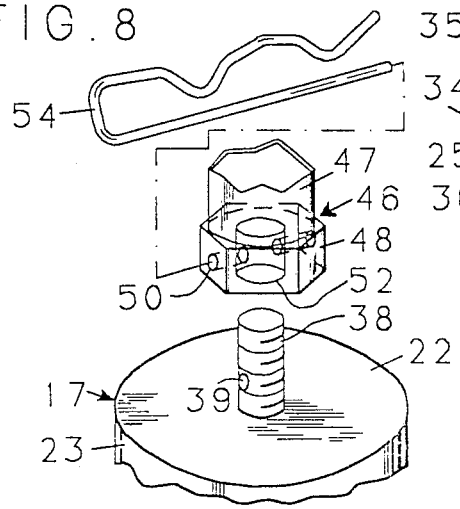
FIG. 8. Enlarged perspective view of handle attachment to round form of chimney cleaner.

Also illustrated in FIGS. 1, 2, and 3 is a threaded stud 38 connected to and projecting from the top capped end 22 surface to provide a means to reversibly connect handle assembly 46 (shown in FIG. 8). The center position of threaded stud 38 on the top capped end 22 surface enables rotation of the round cleaner by rotation of handle assembly 46. FIG. 8 illustrates how torque applied to handle assembly 46 can be transfered through the threaded connection to rotate the chimney cleaner without unscrewing the connection. Stud 38, connected to top capped end 22 surface, has clasp hole 39 through it such that threaded hole 52 of nut 48, welded to handle sections 47, provides an interlocking means that can be screwed thereon such that clasp hole 50, through nut 48, aligns with clasp hole 39. Pin clasp 54 is inserted through clasp holes 50 and 39 interlocking the handle assembly 46 to stud 38 thereby permitting rotation without unscrewing. Nut 48 is welded to handle section 47 to which more sections of handle 47 can be connected endwise to provide a semi-rigid, thin handle 46 that provides a unitary means to reciprocate and/or rotate the chimney cleaner in a flue.

FIGS. 2 and 5, a perspective view and a top view of a square planform chimney cleaner, illustrates how a plurality of kinked, semi-elliptical bowed springs 26 (and 26D), mounted in spaced apart relationship around body 17 on perimeter sides consisting of sides 23 and bevelled sides 21, reach out to cover inner surfaces 41 of a square chimney flue 40S. They are connected by lap mounting in a similar fashion to those of the round chimney cleaner described above. Furthermore, diagonal spring strips 24D (shown in FIG. 7) must be longer than side spring strips 24 (shown in FIG. 7) so kinked, semi-elliptical bowed springs 26D, made therefrom and attached to bevelled sides 21, project peak 29 with attached rasper 30 a greater distance to reach the creosote deposits 42 (Shown in FIG. 17) in the more distant corners of a square chimney flue 40S.

The rectangular form of the chimney cleaner with rectangular planform is illustrated in FIGS. 3 and 6 in a perspective and top view as done in the preceding paragraph for the square chimney cleaner. Again the same relationship holds for the differing length between spring strips 24 and 24D (not shown). The rectangular chimney cleaner, unlike the square form, has a rectangular body 17 in combination with an array comprised of numerous kinked, semi-elliptical bowed springs 26 and 26D that has a rectangular planform shape to provide additional coverage for the longest sides and four corners of a rectangular chimney flue 40R. As with the round and square forms, handle assembly 46 is screwed onto stud 38 that is attached to the top capped end 22 surface and locked with pin clasp 54 as pictured in FIG. 8 to avoid unintentional disconnection from unintentional rotation during use. However, as with the square cleaner no rotation is necessary to clean creosote deposits 42 (shown in FIG. 16) adhering to inner surfaces 41 of rectangular chimney flue 40R.

Spring strips 24D and 24 (that form kinked, semi-elliptical bowed springs 26D and 26) are comprised of cold rolled, hardened strip steel with a C 37 to C 43 temper. This has proven to be best because it is very flexible and resilient while having enough ductility to bend and kink without fracturing during manufacturing. As described earlier spring strips 24 and 24D are, in the preferred embodiment, kinked with bends 27M, 27L, and 27E to form a kinked curvature, instead of the natural curvature delineated with dotted lines in FIG. 7. Reasons for this are discussed later.

Referring now to FIG. 9. Rasper 30 is shown in detail to consist of two end tabs 32, cutting edges 35, and a rasping surface 34 with grooves 36. They are made from a rather hard metal to resist wear, but end tabs 32 on both ends of rasper 30 must be ductile enough to interlock with notches 25 and bend to clamp around to the concave surface 31 of kinked, semi-elliptical bowed springs 26 and 26D. Grooves 36, etched into rasping surface 34 of rasper 30, are at an angle of about 45 degrees from edges 35 to maximize file action as they are forced onto and dragged against hard creosote deposits 42 (shown in FIG. 16).

FIG. 10 shows in detail how raspers 30 and 30L are attached and clamped onto a kinked, semi-elliptical bowed spring 26 (and 26D). End tabs 32 thereof interlock notches 25 at peak 29 and are bent about to the concave surface 31 of kinked, semi-elliptical bowed spring 26 (and 26D) so it is secured and can not slide or disengage while in use. When clamped into position edges 35 salient to convex surface 33 face squarely toward both ends 28T and 28B. Edges 35 penetrate and cut into relatively soft or brittle creosote deposits 42 (shown in FIG. 16) to scrape and plow them away, but they will only skate over glazed deposits, the dangerous form. Rasping surface 34, etched with grooves 36 much like a rasp-file, will grind away glazed deposits too hard for edge 35 to penetrate thereby removing these stubborn deposits with repeated grinding strokes.

Figure 12:
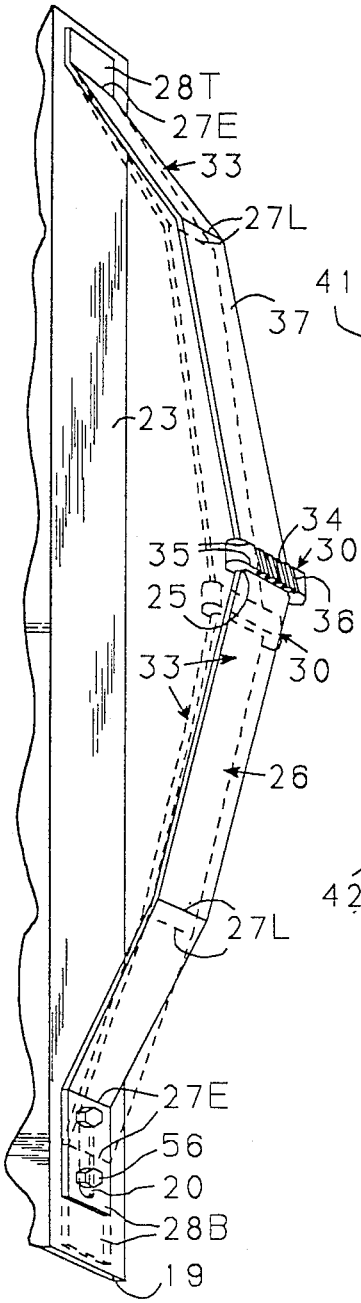
FIG. 12. Perspective view of one kinked, semi-elliptical bowed spring with one of the two end sections thereof reversibly attached to the body to provide an adjustment means (another embodiment of the invention).

FIGS. 11, 12, and 13 illustrate alternate embodiments of this invention and in particular FIG. 11 shows a perspective view of a kinked, semi-elliptical bowed spring 26 (and 26D), with three clamped raspers 30 and 30L attached, lap mounted to side 23 surface. Additional raspers 30L are added on bends 27L, bilateral to peak 29, making a total of three clamped onto a single spring member. This embodiment also requires two additional sets of notches 59L near bends 27L (shown in FIG. 7) to engage new raspers 30L in a method identical to that shown by FIG. 9. Both side and diagonally mounted kinked, semi-elliptical bowed springs 26 and 26D can be notched to hold additional raspers 30L.

Referring now to FIG. 12 showing a perspective view of an adjustable kinked, semi-elliptical bowed spring 26. Only one end 28T is lap mounted and fixed to side 23 surface, leaving the other end section 28B thereof attached in such a way as to be easily moved and resecured by the user. This allows for curvature adjustment so either a shallow or deep curvature can be chosen to change the size of the chimney cleaner to match a wide range of flue dimensions. Thus, one chimney cleaner can be adjusted to clean uncommon flue sizes. FIG. 13 is a detailed perspective view of the adjustable connection showing that bolt 56, inserted through hole 55 of end section 28B, can slide to and fro inside slot 20 to a multiple of positions each with different distances from anchored end 28T. Furthermore, stud 57 of bolt 56, inserted through slot 20, has a lockwasher 60 and nut 58 screwed onto it to provide a means to tighten and friction lock end section 28B to body 17 at a position of choice so a curvature of choice can be obtained. Cavity 18 (shown in FIG. 15), inside body 17, is accessible due to an bottom open end 19 so nut 58 can be loosened or tightened as needed during adjustment.

Figure 14:
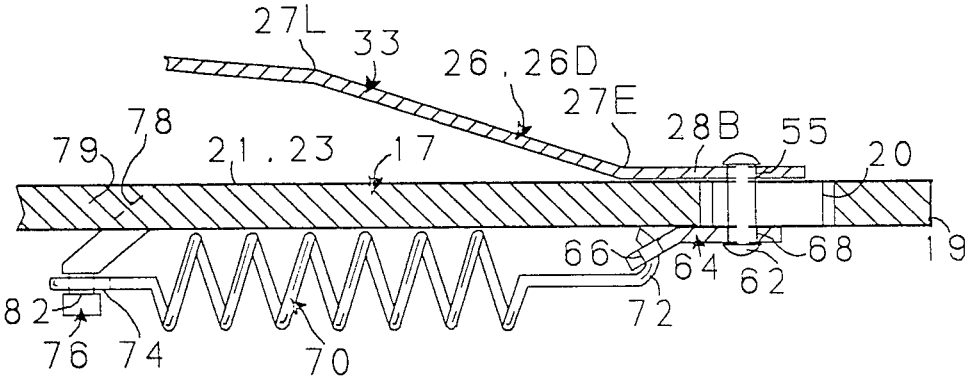
FIG. 14. Enlarged side and sectional view of another adjustment means providing continuous self-adjustment of kinked, semi-elliptical bowed spring curvature automatically, during use (another embodiment).

FIG. 14 is a sectional view of an another alternate embodiment with a coil spring opposed adjustment means. End section 28B of kinked, semi-elliptical bowed spring 26 (and 26D) has rivet 62 inserted through hole 55. Rivet 62 extends through slot 20 as well to the inside of the body 17 surface and into cavity 18 where it goes through rivet hole 68 of slide bracket 64. Rivet 64 is then headed so as to allow the assembly to be loose enough to slide freely to any position in slot 20. A coil spring 70 with bracket hook 72 through hook hole 66 of sliding bracket 64 has its other end, tab hook 74, engaged in groove 82 of tab 76 to effectively anchor it to body 17. Tab 76 is a part of body 17 surface that has been punched out and bent into cavity 18 at bend 78 leaving tab cutout 79. The elastic modulus of coil spring 70 must be such that it will stretch and allow end 28B to move outward more distant from end 28T (now shown in FIG. 14) to relax the arch only when and if excess compression of a kinked, semi-elliptical bowed spring 26 (and 26D) ensues. Thus, raspers 30 remain pressed onto deposits with adequate force. In short, this provides a means to limit overcompression and avoid meandering of the flexible curvature of a kinked, semi-elliptical bowed spring 26 (and 26D). Meandering, as explained in the next section, causes a reduction of outward force applied to raspers 30 so it is not desirable.

OPERATION OF THE INVENTION

The chimney or tube cleaning device described of this invention removes even hard, baked on creosote deposits 42 that adhere to inner flue surfaces 41 by forcing grooved rasping surface 34 and edges 35 through such deposits as the cleaning device is reciprocated like a piston inside the flue 40 of a chimney 87. Furthermore, this cleaning device can remove soot and creosote deposits 42 with simple bidirectional to and fro strokes to maximize cleaning efficiency without complex procedures thereby minimizing the time required. FIGS. 1, 2, and 3 show that all three planforms of this cleaning device (round, square, and rectangular) use the same rasper 30 elements to remove choking deposits of various consistencies.

Raspers 30 provide two methods of deposit removal. The first method uses edges 35 and is more effective in removing creosote deposits 42 that are thick and brittle in consistency. These deposits are found in hotter zones of the chimney flue 40, nearer to the combustion source;

force generated from a kinked, semi-elliptical spring 26 (and 26D) causes rasper 30 penetration into such deposits and edges 35 thereof peel away such deposits as the cleaning device is stroked. The second method is more effective in removing very hard glazed creosote deposits 42 found in colder zones of a chimney 87 (shown in FIG. 17), farther from the combustion source. These deposits are usually very dangerous in nature and unfortunately they are also harder to remove because they are uncharred and not brittle; edges 35 can not penetrate and remove such deposits so rasper 30 slides over, without removing them so they are left behind. While doing so rasping surface 34 of rasper 30, with etched grooves 36, slides over the stubborn deposits and grinds like a rasp file to grind away hard, stubborn deposits of this type, finally removing them after many repeated strokes. Furthermore, the midsection of rasper 30 that consists of edges 35 and rasping surface 34 is hardened like a file to resist wear from friction during use. Thus all deposits are removed effectively, even those with very hard, glaze consistencies that tend to be inflammable and dangerous.

Essentially this cleaning device shown in FIGS. 1, 2, and 3 consists of a plurality of spring strips 24 and 24D (shown in FIG. 7), mounted as described and placed in spaced apart fashion around the perimeter of body 17, to form an array of flexible kinked, semi-elliptical bowed springs 26 (and 26D) that radiate outward from and about 17. Raspers 30 are interlocked with notches 25 and clamped, with end tabs 32, around kinked, semi-elliptical bowed spring 26 (and 26D) members at peak 29 so they are salient thereof to be the most distal elements of this cleaning device. Cleaning device insertion, with an array of semi-elliptical bowed springs 26 (and 26D), into a chimney flue 40 that has an aperture smaller then the relaxed size of said array requires equal compression of all members. Once inside members of the array are crushed and body 17 is generally centered inside the aperture of the chimney flue 40. Raspers 30 salient to the convex surfaces 33 of the spring members are likely to puncture said deposits since all of this outward force is concentrated in pressing the small surface area of the grooved rasping surface 34 (of raspers 30) onto such deposits. If the deposits are too hard to puncture, file-like rasping surface 34 grinds them away.

Furthermore, as raspers 30 cut squarely through, hard and sticky creosote tends to dislodge and fall away as large clumps so creosote deposits 42 near rasper path 85 (shown in FIG. 16) errode and dislodge as well. Adjacent rasper paths 85 errode wider from repeated rasper strokes until they meet. Deposits between adjacent raspers 30 not scraped over are removed effectively through this erosion. Square and rectangular cleaners rely on this principle since they are designed to clean an entire section of flue simultaneously and can not be rotated while inside the flue. These chimney cleaner forms have an array that contains numerous kinked, semi-elliptical bowed springs 26 (and 26D) spaced apart, but sufficiently close to insure adequate coverage and thorough cleaning at least in part by erosion as the cleaning device is moved through the chimney flue 40 with piston-like strokes. The round cleaner form with a circular planform array can and should be rotated as it is stroked inside chimney flue 40 to provide complete removal of the entire deposit coat.

In chimney construction short cuts are sometime used. The most common and troublesome for chimney cleaning is the practice of korbling chimney flue 40 liners, leaving offsets 83 that project into the conduction channel as shown in sectional view, FIG. 15. The kinked, semi-elliptical bowed springs 26 (and 26D) each flex around this or other obstructions, independently, so they can slip by these problem areas and resume original shape and function on the other side. The sloping curvature of convex surface 33 guides rasper 30 around a problem area much like an inclined plane. An offset 83 or obstruction projecting into the conduction channel contacts the leading incline surfaces 37 first and slides along this inclined surface compressing the arch-like curvature as the stroke continues so rasper 30 attached to peak 29 (not shown) follows and is guided around an obstruction to pass it easily without damage. The chimney cleaner will not get stuck in these problem areas because an inclined surface leads the progress of rasper 30 in both to and fro directions due to the bilateral symmetry of the kinked, semi-elliptical bowed spring 26 (and 26D).

Figure 15:
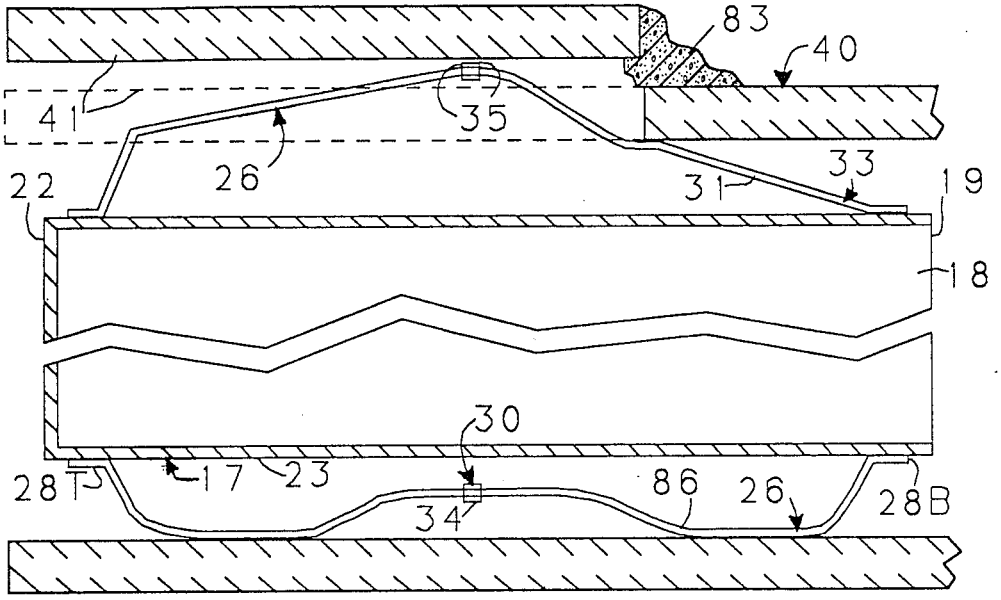
FIG. 15. Section view of kinked, semi-elliptical bowed springs under flexion.

FIG. 15 shows how the user adjustable feature increases the cleaning efficiency of this invention. Kinked, semi-elliptical bowed spring 26 (and 26D) when compressed and crushed too much, as is the case when they are inserted in very small crossectional flues or those with thick deposits and severely restricted apertures, tend to meander and form a loop 86 so rasper 30 attached at peak 29 (not shown) bends away from the inner surfaces 41 of chimney flue 40 as shown in dotted lines. This is undesirable because the applied force to press rasper 30 onto creosote deposits 42 (shown in FIG. 17) is decreased as a result. This can be prevented in three ways: first by adding additional raspers 30L bilateral to the most distal (of the cleaning device) rasper 30 on peak 29 as shown in FIG. 11 to contact deposits and clean when curvature meandering happens, second by adjusting the kinked, semi-elliptical bowed spring 26 (and 26D) to a shallow, less steep curvature as illustrated in FIG. 12, delineated with dotted lines, so overcompression is avoided when cleaning extremely restricted and/or small flue apertures, or third by kinking the arch curvature to form peak 29 (Bend 27M of FIG. 7 and 9) that opposes loop 86 (shown in FIG. 15) formation from meandering. The user adjustment feature also allows for adjustment of the array size on a single cleaning device enabling it to effectively clean a wide range of uncommon, nonstandard flue sizes and a multitude of flue shapes as described earlier.

Adjustment of the curvature can be manual or automatic. FIGS. 12 and 13 illustrate the first method, manual. Nut 58 of bolt 56 can be loosened so end section 28B can be moved and secured to a new position on side 23 of body 17 to adjust the curvature of a kinked, semi-elliptical bowed spring 26 (and 26D) to the proper height and slope so it will not be overcompressed in the smallest aperture likely to be encountered during use. The second method, automatic, achieves the same results continuously during use without any operator intervention. FIG. 14 shows how this is done. Coil spring 70, with one end stationary hooked to body 17 on tab 76 and the other end connected to end section 28B through sliding bracket 64 and rivot 62, is allowed to stretch as end section 28B is forced to move out under excessive compression on convex surface 33 of the arch-like curvature. The spring constant of coil spring 70 is such that only excessive pressure on the kinked, semi-elliptical bowed springs 26 (and 26D) is relieved in this manner so raspers 30 have adequate applied force to remain pressed onto creosote deposits 42 (shown in FIG. 17).

FIG. 7 is a sectional view of a kinked, semi-elliptical bowed spring 26 (and 26D) showing how bends in five places kinks its curvature. When compared to the unbent natural curvature of the same strip of steel, delineated in dotted lines, it can be seen that greater peak 29 to body 27 heights (peak height) can be achieved by simply kinking the curvature. This is preferred at least in part because greater peak height is realized, but this also maximizes the effective range to which a bowed spring member can be crushed before loop 86 (shown in FIG. 15) formation occurs and reduces spring generated pressure on rasper 30. Thus, a wider range of flue sizes can be cleaned with increased efficiency without the need for any adjustment of the flexible curvatures of the kinked, semi-elliptical bowed springs 26 and 26D.

Figure 17:
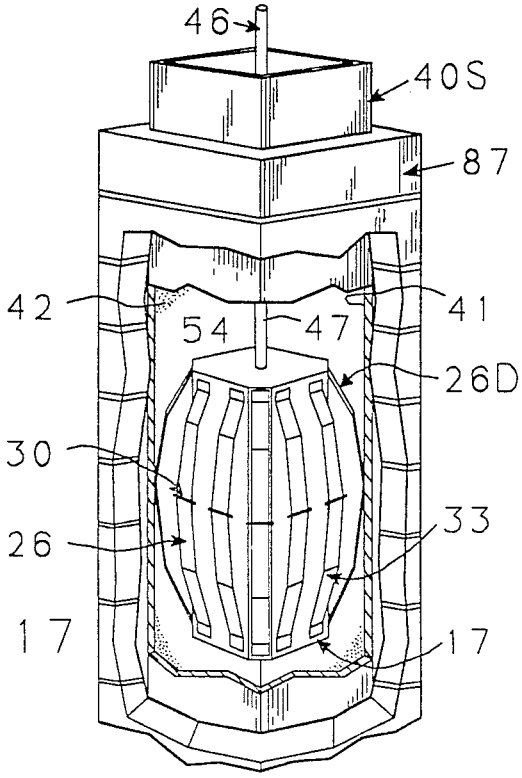
FIG. 17. Perspective cutaway view of a square form chimney cleaner with square planform in a square flue lined chimney.
Figure 16:
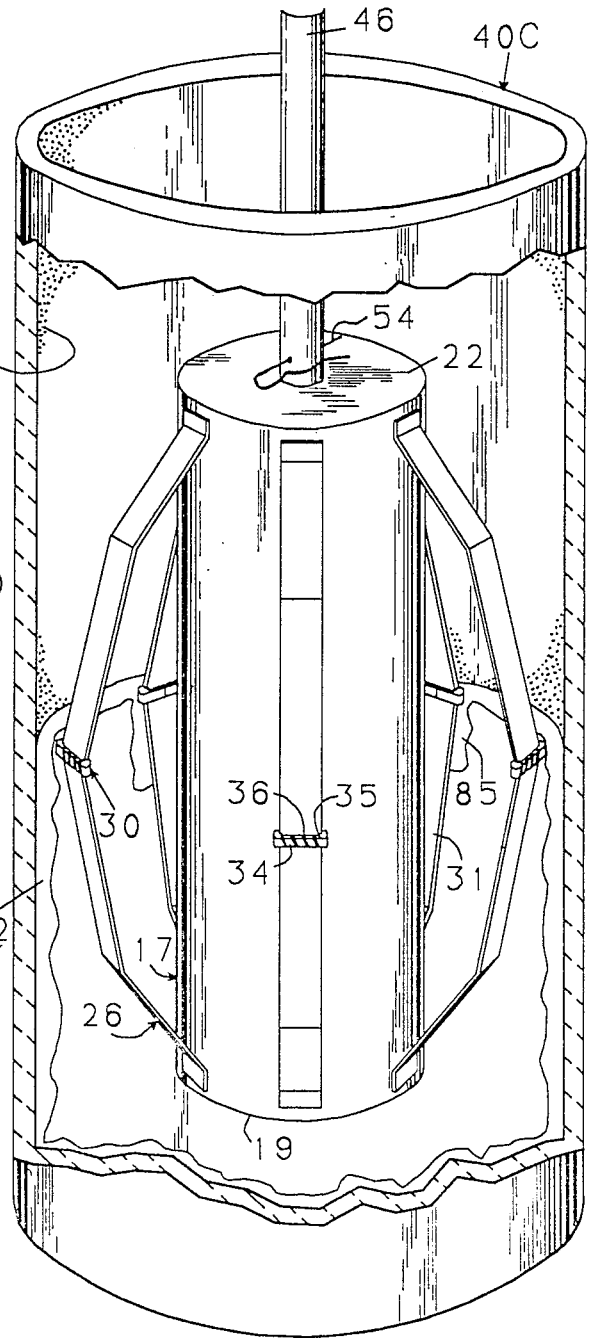
FIG. 16. Perspective cutaway view of a round form chimney cleaner with circular planform in a section of a round tube.

FIGS. 16 and 17 show perspective views of the chimney cleaner in use. FIG. 16 shows the circular planform chimney cleaner in a cut-away section of round hollow ware or chimney flue 40C. The operator pushes and pulls on the long, thin handle assembly 46 connected to the cleaning device to reciprocate it like a piston inside and along the longitudinal axis of the flue 40C. Many repeated piston strokes with some rotation during each stroke will provide complete coverage and cleaning. Path 85 is cut by rasper 30 as it is repeatedly forced to move and plow squarely through creosote creosote deposits 42. FIG. 17, a perspective view of a square planform chimney cleaner in a chimney 87 with a square flue 40S, shows how this cleaning device provides adequate coverage of inner surfaces 41 of this flue 40S. This cleaning device can not be rotated and must rely on the square planform array and the spacing of the kinked, semi-elliptical bowed springs 26 (and 26D) members thereof to effectively remove creosote deposits 42 as described earlier. Creosote consistency helps because it is somewhat sticky so it tends to dislodge and erode away as clumps from the sides of a rasper path 85 (shown in FIG. 16) as it is cut so raspers 30 do not have to cover all deposits but instead they can be spaced apart in a planform array, almost a rasper length apart, and still remove most if not all deposits 42. The design of the rectangular planform chimney cleaner relys on this principle to clean also.

CONCLUSION, RAMIFICATION, AND SCOPE OF INVENTION

Thus, the reader can see that the chimney flue or tube cleaner of this invention provides a cleaning device to mechanically grind and remove hard glaze deposits from inner surfaces of flues or the like, heretofore not possible with utilization of prior art methods or cleaning devices. This invention utilizes: many small, hard raspers to concentrate spring generated force over short chisel-like edges and a small grooved rasping surface to maximize penetration into creosote deposits, a plurality of novel kinked, semi-elliptical bowed springs with arched curvatures to provide the necessary force and flexibility that is needed to press salient raspers attached thereon onto creosote and slip past offsets or obstructions without becoming lodged inside the chimney flue, and replaceable grooved raspers that file and grind creosote deposits which can be replaced as needed so like-new cleaning efficiency is maintained.

The above description contains many specificities that should not be construed as limitations on the scope of this invention, but rather as an exemplification of the preferred embodiment(s). Other embodiments such as a scraping means intregral to the convex surface, instead of a separate part clamped to and around the kinked, bowed semi-elliptical springs can be envisioned; to replace these scraping means the kinked bowed spring must also be replaced. The semi-elliptical bowed springs can be made from springs wires that are zigzagged like upholstery springs instead of thin strips of spring material. When mounted to the body they form a bowed curvature that can hold a scraping means and perform much like the springs made from thin spring strips. Another embodiment is of consequence only to the cleaner with circular planform because rotation can occur. Saw teeth cut into one or more thin side(s) of a spring strip that is bowed into a semi-elliptical curvature can saw into and aid creosote removal if the cleaning device is rotated during use. Other embodiments too numerous to mention relate to alternate designs of this cleaning device's adjustment means, handle attachment means, rasper attachment means, and cleaning means. Lastly, kinked, semi-elliptical bowed springs in combination with attached rasper(s) can be mounted n body surfaces so they have a curvature plane that is not exactly parallel to the longitudinal axis of said body, but instead has a small slant angle with-respect-to said axis. Rasper edges and a leading corner can now plow through creosote deposits at a slight angle to produce a slicing effect and impart a small rotational torque to the device, both of which enhance cleaning. Many of the most important embodiments have been described here and in the preceding text, but many others can be envisioned that do not in any way alter or limit the main objectives and ramifications of this invention; only the claims and reasonable interpretation of same can constitute limitations of this invention.

We claim the following:

1. A tube and chimney cleaning device for removing hard, crusty deposits from a conduction channel inside on elongated chimney flue or the like that has a predetermined and nearly constant crossection shape throughout, said device is comprised of: an elongated body of cross-sectional shape generally similar to the cross-sectional shape of the elongated chimney flue or the like to be cleaned but smaller in size to enable insertion into the tube or chimney flue aperture to be reciprocated, said elongated body is capped at the proximal top end, last to enter the chimney flue or tube aperture; a plurality of bowed spring members disposed in spaced-apart fashion about the outside surfaces of said body that provides a common support means, said bowed spring members being of resilient material having first terminal end bent to be lap mounted semi-permanently to the side surfaces of said body nearest an open end of said body whereby attachment to various positions on said side surfaces can change the bowed extent of the curvature of a substantially semi-elliptically shaped flexible arch projecting outward, interposed between said first terminal end and a second terminal end bent to be lap-mounted to another point on the side surface of said body nearest the proximal top capped end of said body to hold said bowed spring members in adjusted position and curvature, said first terminal end and said second terminal end are independently positioned on side surface of said body so the flexible arch of said bowed spring member spans said elongated body generally parallel to the longitudinal axis of said body whereby the convex surface of said bowed spring member extends outward from and generally normal to the sides of said body; a plurality of scraping means attached to the convex surface of said flexible arch comprised of a grooved rasping surface raised outward from said convex surface interposed between bordering chisel-like edges held salient and attached generally normal to said convex surface, said chisel-like edges bordering said grooved rasping surface on both sides are disposed generally perpendicular to a plane that slices through said flexible arch and projects outward along said flexible arch from said body thereby providing a means to plow through, grind away, and scrape away interfering deposits in use; a unitary stroking means comprised of many short, generally thin members reversibly connected together in endwise fashion to form a semi-rigid and slender elongated member that has sufficient length to traverse a predetermined length of chimney flue or the like, and a terminal end that reversibly connects to a connection means attached onto said proximal capped top end of said body whereby said cleaning device can be stroked to and fro through the conduction channel of chimney flues or the like.

2. The cleaning device of claim 1 wherein each member from said set of bowed spring extend outward to form an array of said bowed spring members that surrounds said body with a predetermined planform of crossectional shape substantially similar and larger than the crossectional shape of said body and the tube or chimney flue aperture to be cleaned, said convex surface of said flexible arch in combination with said scraping means saliently attached thereto and carried thereby crushes inward toward said body from deforming forces created during compression of said array whilst inside the chimney flue being cleaned whereby substantial force is generated to press said scraping means comprised of said raised grooved surface and said sharp edges onto creosote deposits, said flexible arch of each member from said planform array of bowed spring members in combination with said scraping means can contort independently without affecting others, whereby said body providing a common support means to all members of said planform array generally remains in centered relation on passage thereof past an unyielding obstruction that projects into and partially blocks the conduction channel, said scraping means lapped on said convex surface is reversibly attached and held firmly by tabs formed from opposite terminal ends thereof that extend beyond said convex surface on both sides of said bowed spring that bend to engage and interlock with notches cut into opposing sides of said bowed spring and further bend about to the underside of said flexible arch and contact a concave surface whereby said scraping means remains securely clamped, disposed transversely across the convex surface of said bowed spring member from side to side so said chisel like edges bordering said grooved rasping surface on both sides are orientated to face substantially square into bidirectional to and fro stroke movements whereby hard deposits are ground and scraped away in use, said grooved rasping surface raised from said convex surface consists of numerous grooves cut into the raised surface on the midsection of said scraping means interposed between said chisel like edges whereby hard deposits not scraped away are ground away in use, said scraping means is made from a hard material to resist wear that must bend to the extend required for said tabs to reversibly clamp about and interlock with said notches that provides a means to replace said scraping means.

3. The cleaning device of claim 1 wherein said proximal capped end of said body has said connection means attached to reversibly connect with said unitary stroking means disposed generally normal, colinear to the longitudinal axis of said body when connected in use, said unitary stroking means having a handle assembly with an interlocking means at one end that joins and interlocks to said connection means attached to said proximal capped end of said body whereby rotational torque can be transfered from said handle assembly through said interlocking means to said base so said cleaning device can be rotated axially while inside a tube or chimney flue without disengagement thereof, said handle assembly is semi-rigid to traverse slight corners or bends in the tube or chimney flue encountered during to and fro stroking in use.

4. The cleaning device of claim 1 wherein said array of said bowed spring members forms a substantially circular planform to clean tubes or chimney flues of circular cross-section consisting of said numerous flexible arches attached to and radially disposed in spaced apart relation about the perimeter of said side surfaces of said body along a plane that includes the longitudinal axis of said body and extends radially outward from said body that is a shell with a substantially elongated cylindrical shape for holding said radially disposed bowed springs in adjusted curvature and spaced apart relation to form said circular planform.

5. The cleaning device of claim 1 wherein said array of said bowed spring members forms a square planform that has two types of said bowed spring members consisting of a set of side and diagonal bowed spring members to clean the sides and corners of tubes or chimney flues with square cross-section, said body is a elongated shell that has a substantially square cross-sectional shape with champered corners to provide a bevelled surface or the like interposed between adjacent perpendicular side surfaces whereby said diagonal bowed spring members, attached substantially normal thereto and held in adjusted curvature thereby, are disposed along a diagonal plane that includes the longitudinal axis of said body extending through said bevelled surfaces further extending to the corners of the square tube or chimney flue in use, said set of side bowed spring members attached substantially normal to and spaced apart on said perpendicular side surfaces extend to the inner side surfaces of a square tube or chimney flue whereby equally distributed cleaning is obtained with reciprocating to and fro strokes.

6. The cleaning device of claim 5 wherein said array of said bowed spring members forms a rectangular planform surrounding a substantially rectangular-shaped body consisting of an elongated rectangular-shaped shell with champered corners made from said perpendicular side surfaces, two of which on opposing sides have greater length whereby a generally rectangular shape is provided, joined together similar to said square body.

7. The cleaning device of claim 1 wherein an adjustment means comprised of a slot cut longitudinally into said side surfaces of said body nearest said open end, said first terminal end of said bowed spring member bent to be lapped over said slot and attached to said side surface by a sliding means that slides within said slot, and friction lock means comprised of a hand screwable tightening means with sufficient length to be connected through a hole in said first terminal end, extending through said slot to the inside of said body where a widened end restricts passage of said widened end through said slot, hand tightening of said tightening means reversibly clamps said first terminal end to said side surface whereby said flexible arch is held in adjusted relation by friction.

8. The cleaning device of claim 1 has a spring-actuated adjustment means comprised of said body, said slot cut longitudinally into said side surfaces nearest said open end thereof, and said first terminal end of said bowed spring member bent to be lapped over said slot and attached to said side surface by a slide connection means comprised of a rivet of sufficient length connected through said hole in said first terminal end, extending through said slot and connected through a hole in a sliding bracket disposed on the inside of said side surfaces that is further connected to a bracket hook formed from the first terminal end of said coil spring, said coil spring has a tab hook formed from a second terminal end thereof to engage a tab anchored to and placed nearest to the proximal capped end of said body whereby said slide connection means can move longitudinally within said slot and stretch said coil spring to lessen the bowed extent of said flexible arch and reduce the size of said planform array thereby reducing the compressive forces crushing said bowed spring member, said coil spring resists the sliding of said slide connection means whereby a force remains to press said scraping means outward, said adjustment means is attached to each of said bowed spring members whereby independent sliding thereof along said slot provides changes of the curvature of said flexible arches separately and independent of others.

* * * * *